United States Patent [19]

Hinterberger

[11] Patent Number: 4,717,903

[45] Date of Patent: Jan. 5, 1988

[54] TRIMMING RESISTOR

[75] Inventor: Leopold Hinterberger, Höhenkirchen, Fed. Rep. of Germany

[73] Assignee: Wilhelm Ruf Kg, Munich, Fed. Rep. of Germany

[21] Appl. No.: 808,914

[22] Filed: Dec. 13, 1985

[30] Foreign Application Priority Data

Jan. 11, 1985 [DE] Fed. Rep. of Germany ..... 3500771

[51] Int. Cl.[4] ..... H01C 10/32

[52] U.S. Cl. ..... 338/162; 338/171

[58] Field of Search ..... 338/160, 162, 163, 165, 338/166, 171

[56] References Cited

U.S. PATENT DOCUMENTS 2,151,625 3/1969 Thompson ..... 338/170

2,160,142 5/1939 Hathorn ..... 338/170

2,839,642 6/1958 Dickinson et al. ..... 338/170

FOREIGN PATENT DOCUMENTS 896315 5/1962 United Kingdom .

*Primary Examiner*—E. A. Goldberg

*Assistant Examiner*—M. M. Lateef

*Attorney, Agent, or Firm*—Neuman, Williams, Anderson & Olson

[57] ABSTRACT

A trimming resistor is provided including a housing formed with a central through bore in which a rotary driver is supported for rotation. The rotary driver supports a spring ring which has a resilient tongue to press a small contact plate against a resistance plate provided with brush tracks. The rotary driver interfits with the spring ring as well as the small contact plate.

6 Claims, 18 Drawing Figures

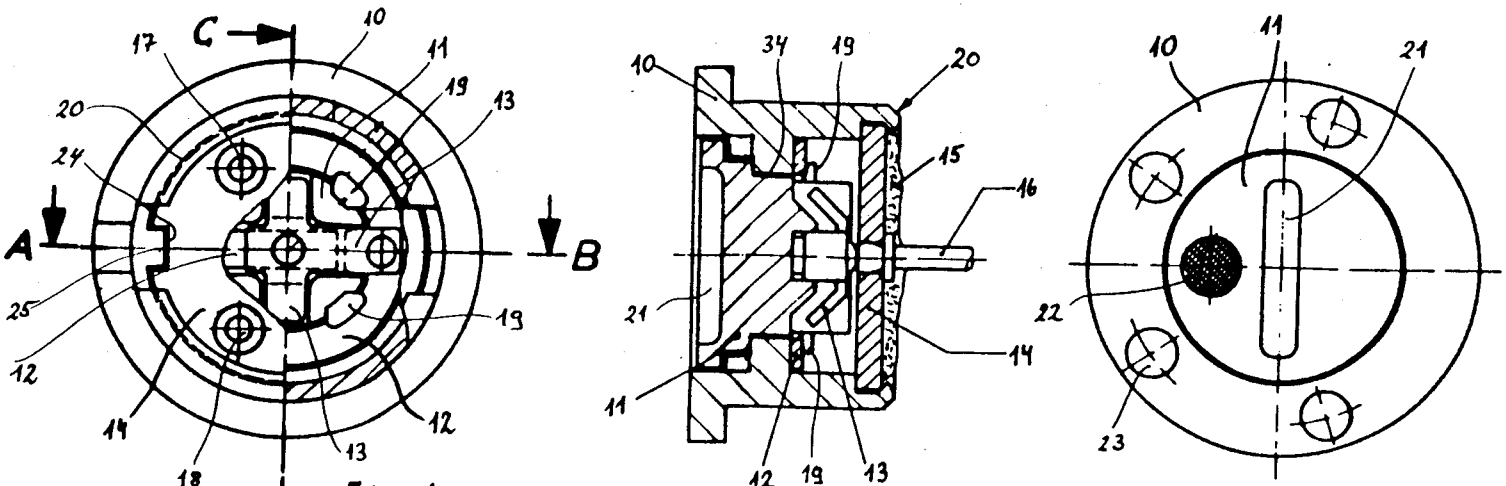
Fig. 1A
Fig. 1B
Fig. 1C
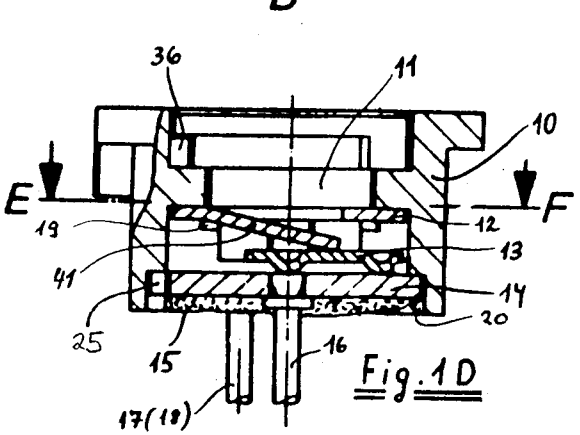
Fig. 1D
Fig. 1E
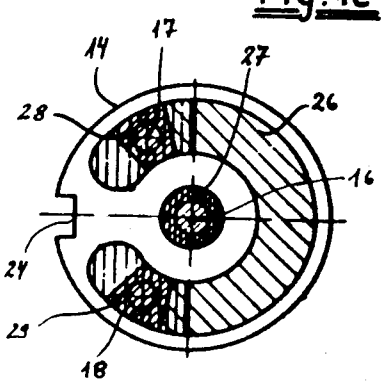
Fig. 2

TRIMMING RESISTOR

BACKGROUND OF THE INVENTION

Field of the Invention

The instant invention relates to a trimming resistor, especially a miniature trimming resistor, comprising a housing, a resistance plate including a brush track, a brush resiliently biased against the brush track, and a rotary driver for the brush, being supported in the housing. Such trimming resistors are commercially available in the most varied structural forms. It is customary in general to design the brush or wiper contacts as hemispherical projections of spring arms or brush or wiper arms. These arms consequently serve a dual purpose: They establish an electrical connection including the contact making and they provide the contact pressure force.

An earlier brush spring of a trimming resistor devised by the applicant of the instant application comprises a flat body from which two lateral arms originate that are bent towards each other inwardly by a bending angle in the order of 170°. The ends of both arms each carry a brush contact. One of the arms is recessed in the middle so that the other arm may pass through this recess.

At extreme miniaturization great expenditure is required if such a wiper spring is to be produced accurately. Furthermore, the exact location of the meeting point of the contact and a "brush track" as well as the mutual spacing of the two contacts depends on the bending angle of the two arms. At extreme miniaturization this calls for strict tolerance requirements to be met and results in correspondingly great numbers of rejects. Finally, at extreme miniaturization the spring pressure or contact pressure required for sufficient contact making between the contact and the wiper track can no longer be obtained with the usual resilient contact materials.

It is, therefore, an object of the instant invention to improve the trimming resistor of the kind specified initially such that it will be easy to manufacture. It is another object of the invention to provide a trimming resistor of the kind in question which will operate perfectly during a long service life.

This object is met, in accordance with the invention, in that the brush is a substantially planar, small contact plate arranged parallel to the surface of the resistance plate, and that a separate spring ring is provided whose resilient tongue presses the small contact plate against the resistance plate.

Advantageous modifications and further developments of the invention may be gathered from the subclaims.

Briefly, the invention provides for two different structural members to fulfill the functions of "contact making" and "contact pressure generation", namely a small contact plate and a spring ring cooperating with each other by virtue of their relative positions of installation. In accordance with a further development of the invention these two structural members are so designed that they can be produced easily by stamping or punching tools, observing precise dimensions, and can be assembled and mounted with ease. Manufacturing and assembly tolerances are admissible within rather wide limits as compared to the wiper spring mentioned above, and yet that does not impair the electrical operating features of the trimming resistor.

The invention will be described further, by way of example, with reference to the accompanying drawings, in which:

FIG. 1A is a view of the bottom (connecting side) of the trimming resistor, shown partly broken away;

FIG. 1B is a side sectional elevation along line C–D in FIG. 1A;

FIG. 1C is a top plan view showing the top of the trimming resistor;

FIG. 1D is a sectional view along line A–B in FIG. 1A;

FIG. 1E is a sectional view along line E–F in FIG. 1D;

FIG. 2 is a top plan view of the resistor plate to which resistance or brush tracks are applied;

Identical or corresponding members are designated by the same reference numerals throughout.

DETAILED DESCRIPTION OF THE INVENTION

Figure 3C:
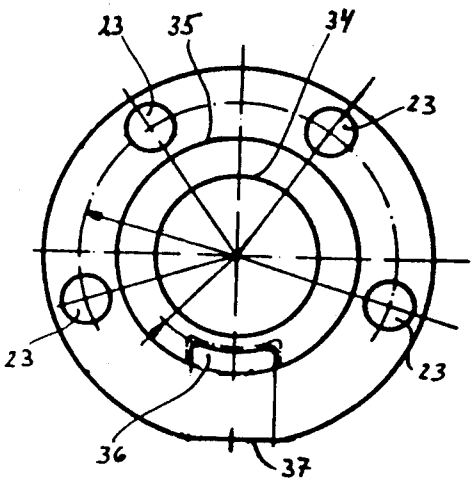
FIG. 3C is a plan view from below showing the bottom of the housing.

Reference first will be made to FIG. 1.

The trimming resistor will be described below with reference to a cylindrical housing. But, of course, it is obvious that square base housings also could be used. With an embodiment realized in practice the outer diameter of the cylindrical housing is about 2.5 mm. This dimension gives an idea of the degree of miniaturization at stake. The cylindrical housing 10 has a through bore into which a rotary driver 11 is inserted from one end. The rotary driver 11 holds a spring ring 12 and a small contact plate 13 whose contacts abut against a resistance plate 14, while the small contact plate 13 is pressed against the resistance plate 14 by a resilient tongue of the spring ring 12. The resistance plate 14 is inserted into the through bore of the housing from the other end thereof (bottom side) and, if desired, sealed in addition by a sealing compound 15, such as an epoxy resin. A total of three connecting wires or terminal pins 16,17, and 18 project from the resistance plate 14.

The individual members are secured as follows to prevent them from falling out:

As may best be seen in FIGS. 1B and 1D, the through bore formed in the housing includes an inwardly projecting circumferential projection 34 (also in FIG. 3B) against which a circumferential shoulder (stepped portion 62 in FIG. 6B) comes to rest. When the rotary driver 11 has been pushed so far into the housing that its stepped portion abuts against the projection 34, the spring ring 12 is pushed over the rotary driver from the other end of the housing until it abuts against the other side of the projection 34 in the housing. Subsequently the rotary driver 11 or spring carrier is calked (by deformation of material) against the spring ring 12 by forming calked ears 19. In this manner the rotary driver 11 and spring ring 12 are secured to the housing 10 in axial direction and cannot fall out, whereas rotary motion still is permitted. Upon inserting the small contact plate 13 into slots (53 and 54 in FIG. 6) the resistance plate 14 is introduced into the through bore in the housing and likewise calked by beading or flanging the lower edge 20 of the housing. In this manner the trimming resistor is assembled and may further be sealed, if desired, by sealing compound 15.

As shown most clearly in FIG. 1C, a screw driver slit 21 is provided in the outside or top of the rotary driver and a wiper or brush position mark 22 is imprinted on the top surface. The upper edge of the housing also includes a number of depressions 23 serving, among others, as markings of the assembly position.

As shown in FIGS. 1A, 1D, and 2, the resistance plate 14 is formed in its outer edge with a recess 24 to be engaged by a projection 25 formed at the housing. In this manner the exact assembly position is fixed for the resistance plate 14 and it is impossible to rotate the same after calking of the housing.

FIG. 2 shows the resistance plate 14 from the top. As will be seen, it is circular (with the exception of the recess 24) and includes a resistance or brush track 26 shaped like a sector of a circular ring and consisting, for example, of imprinted resistive lacquer. When the rotary driver 11 is rotated, a contact (49 in FIG. 5) wipes along the brush track 26. One each of the terminal pins 17 and 18 is connected electrically with the brush track 26 in the area of both ends thereof, the terminal pins themselves being riveted to the resistance plate so as to be flush with the surface thereof. As indicated by the vertical hatching, the ends of the brush track 26 and the flat surface of the terminal pins 17 and 18 are coated by a silver layer, and in addition conductive silver 28 and 29 is applied in the area of the planar surface of the terminal pins (hatching from lower left to upper right in FIG. 2). In the case of the embodiment shown the first silver layer (vertical hatching) is applied in such a way that the area of the brush track 26 (resistive lacquer) left uncovered by the silver amounts to a "range of rotation" of 180°. This means that also the effective rotational range of the trimming resistor is 180°. Of course, other arrangements are feasible as well.

In analogy with the fixing of the terminal pins 17 and 18, the terminal pin 16 is riveted in the center of the resistance plate 14 to constitute the center tap of the trimming resistor. A circular silver layer is printed on the same (hatching from lower left to upper right) and it extends radially beyond the flat riveting surface of the terminal pin 16. In addition conductive silver is applied on top of the same in circular ring shape. This central area 27 will be contacted by the center contact (48 in FIG. 5) of the small contact plate 13.

Figure 3B:
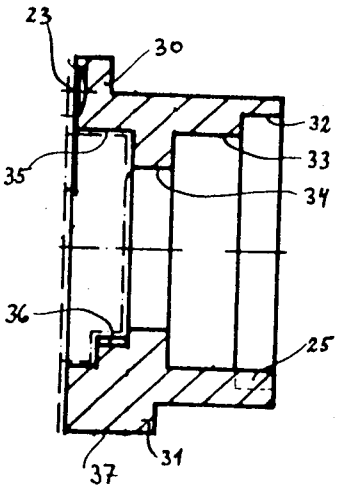
FIG. 3B is a side sectional elevation.
Figure 3A:
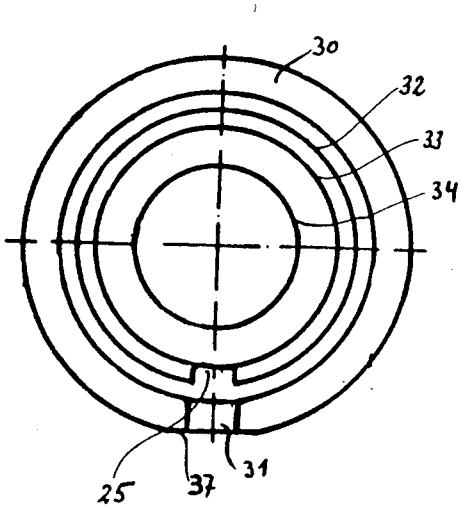
FIG. 3A is a top plan view showing the top of the housing.

Different views of the housing 10 are presented in FIG. 3. This housing 10 essentially is of cylindrical shape and has a through bore. In the range of the left end, as seen in FIG. 3B, the housing is formed with a circumferential flange or collar 30 followed directly by a centering nose 31 for a circular segment cutout.

The through bore in the middle of the housing is formed with various steps. As seen from the end of the resistance plate (from the right in FIG. 3B) there is a first bore portion 32 which has the greatest diameter and into which protrudes the projection 25 which serves to align the resistance plate 14. The first bore portion 32 is followed by a second bore portion 33 forming a step. This step between the first and second bore portions 32 and 33 is the abutment face for the resistance plate 14. The second bore portion 34 is followed by a circumferential projection 34 which defines the smallest diameter of the through bore in the housing. The step formed between the bore portion 33 and the projection 34 serves as abutment for the spring ring 12, as may be seen best in FIGS. 1B and 1D.

The projection 34 in the housing again is followed by a bore portion 35 of greater diameter, the step formed between the projection 34 and this bore portion 35 serving as abutment for the rotary driver 11. There is another projection 36 in the bore portion 35 protruding toward the middle across a smaller angular range and serving as a stop for rotation of the rotary driver 11. This projection 36, in acting as a stop, cooperates with a projection 64 (FIGS. 6A and 6B) provided at the rotary driver 11.

The outwardly protruding collar 30 of the housing 10 may be flattened for a limited extent 37 of its outer periphery. In this manner the exact assembly position in any subsequent line-up becomes visible also from the "top".

Figure 4A:
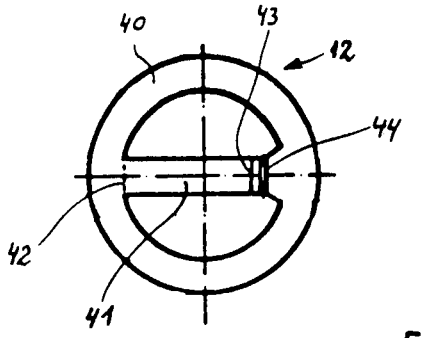
FIG. 4A is a top plan view of the spring ring used with the trimming resistor according to the invention.
Figure 4B:
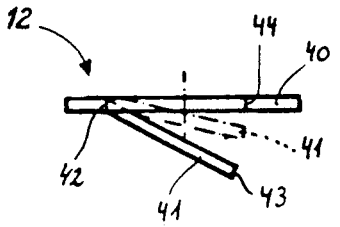
FIG. 4B is a side elevation of the same spring ring.

FIG. 4 is a more detailed presentation of the spring ring 12 which is composed of a body 40 of circular ring shape and a web passing through the interior of the ring and the center of the circle and later on becoming the resilient tongue 41. One end of this web is connected integrally with the body 40, the subsequent bending line 42 in the transitional zone between web and ring being indicated by a dotted line. The opposite end of the web merges with the body 40 by a portion 44 which is conically widened as may be seen in FIG. 4A. A severing cut is provided between the portion 44 and the remainder of the web so that the web may be bent out of the plane of the body 40. FIG. 4B shows two different bending positions of the web. In the finished trimming resistor the free end 43 of the web comes to lie on the small contact plate 13 and provides the necessary contact pressure. The free end of the web now being the resilient tongue 41 touches the small contact plate approximately halfway between the two contacts 48 and 49 whereby the contact pressure of both contacts is approximately the same.

If it is desired for certain cases of application to have different contact pressures acting at the two contacts, this can be accomplished by changing the length of the web or resilient tongue 41.

The inner diameter of the circular ring shaped body 40 is adapted to the outer diameter of a portion of the rotary driver so that the body 40 will surround this portion at the outside whereby the spring ring 12 may be slid on the rotary driver. The web or resilient tongue 41 will enter a slot in the lower end face of the rotary driver 11 so that the spring ring 12 will be taken along when the rotary driver 11 is rotated.

Figure 5A:
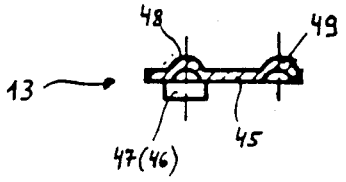
FIG. 5A is a side sectional elevation.
Figure 5C:
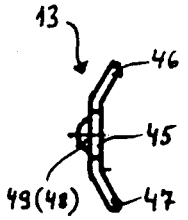
FIG. 5C is a front elevation.
Figure 5B:
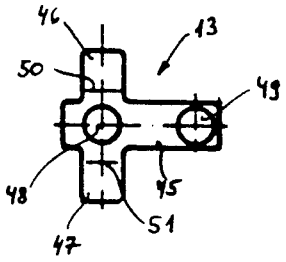
FIG. 5B is a top plan view.

FIG. 5 is a presentation of the small contact plate 13 which is shaped approximately like a "T" or cross in top plan view, as shown in FIG. 5B. The elongated, approximately rectangular body 45 of the small contact plate 13 has two lateral engaging arms 46 and 47 which extend away from the body at right angles in the top plan view of FIG. 5B. As may be taken especially from FIG. 5C, these arms are bent upwardly along bending lines 50 and 51, in the direction away from the resistance plate 14 and the contacts 48 and 49.

In the embodiment shown, the contacts 48 and 49 are designed as hemispherical projections. One contact 48 constitutes the center tap which touches the central area 27, i.e. the silver-coated planar surface of the terminal pin 16 in the resistance plate 14, thus being positioned in the center of rotation of the trimming resistor. The engaging arms 46 and 47 are so arranged that their center line intersects the center of the circle of contact 48.

The wiping contact 49 thus lies at the free end of the body 45. As shown best in FIGS. 1A, 1B, and 1E the engaging arms 46 and 47 being bent upwardly engage in a slot formed in the end face of the rotary driver 11 and extending at right angles with respect to the slot in which the resilient tongue 41 is received. Moreover, the body 45 of the small contact plate to a certain extent may be accommodated in that slot of-the rotary driver 11 which houses the resilient tongue 41 (cf. FIG. 1D). The small contact plate thus is fixed reliably with respect to the rotary driver 11 and is rotated together with the same.

FIG. 6, finally, is a presentation of the rotary driver 11 which essentially is cylindrical and provided with certain formations. From right to left in FIG. 6B there is a first cylindrical portion which has the smallest outer diameter. This outer diameter is adapted to the inner diameter of the body 40 of the spring ring 12. Two slots 53 and 54 are cut at right angles with respect to each other into the front end of this portion, whereby four engaging fingers 55,56, 57, and 58 are left. The slot 53 later on will accommodate the resilient tongue 41 and possibly the body 45 of the small contact plate 13. The two engaging arms 46 and 47 of the small contact plate will be received in the slot 54. The slot 54 may be formed in addition and symmetrically with respect to the center line with two transverse bars 60 and 61 having edges which are inclined downwardly toward the outside (FIG. 6D). Their inclination mates with the inclination of the upwardly bent engaging arms 46 and 47.

Figure 6A:
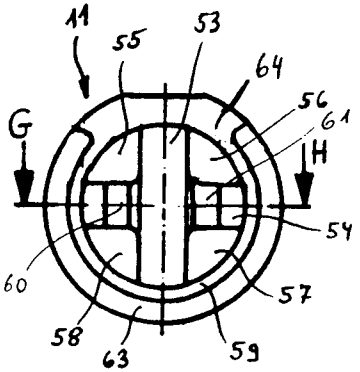
FIG. 6A is a view of the bottom side.
Figure 6B:
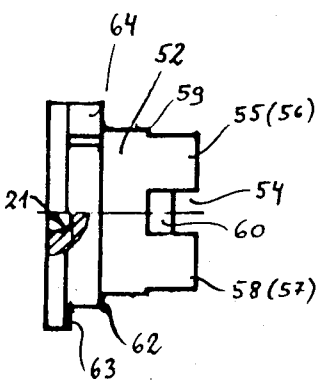
FIG. 6B is a side elevation.
Figure 6C:
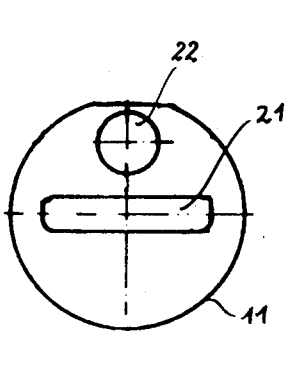
FIG. 6C is a view of the top side.
Figure 6D:
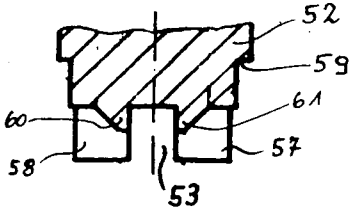
FIG. 6D is a sectional view of the lower end of the rotary driver, shown partly broken away.

The first portion including the four engaging fingers 55 to 58 is followed, from right to left in FIG. 6B, by a portion 59 which is adapted to the inner diameter of the projection 34 in the housing. The axial length of this portion 59 corresponds to the axial length of the projection 34. The apparent "step" in FIG. 6B at this location results from the formation of the slots 53 and 54 because when the slots are cut or milled out of the cylindrical body, material is removed at the outer periphery in the area of the cutting. The portion 59 is followed by another stepped portion 62 the outer diameter of which corresponds to the inner diameter of bore portion 35 with its projection 36 serving as a rotational stop. The stepped portion 62 has a projection 64 which cooperates with the projection 36 to form the stop for rotational movement. Finally there is a stepped portion 63 having an outer diameter which corresponds to the inner diameter of bore portion 35 of the housing.

The portion 52 defined between the steps of portions 59 and 62 represents the actual supporting face of the rotary driver 11.

The calking of the rotary driver with respect to the spring ring is made out of the "flesh" of the four engaging fingers 55 to 58, i.e. by plastic deformation of material. A calking tool which may be heated, if desired, is used to form the calked ears 19, as best shown in FIG. 1A. Together with the projection 34 in the bore of the housing, these calked ears 19 fix the spring ring 12 with respect to the rotary driver 11 and the housing 10. Hereby also the rotary driver 11 is secured in axial direction with respect to the housing 10.

The spring ring 12 may be made of spring steel since its electrical properties are not important for the operation of the trimming resistor. Therefore, sufficient contact pressure can be exerted on the small contact plate, even in the case of extreme miniaturization.

All the technical details shown and described in the claims, specification, and drawings may be essential of the invention, either alone or in any desired combination.

What is claimed is:

1. A trimming resistor construction particularly adapted for incorporation in a miniature trimming resistor, comprising a housing; a resistance plate including a brush track mounted on one resistance plate surface portion; a brush resiliently biased against the brush track; a rotary driver for rotatably driving said brush and supported in the housing; said brush being in the form of a substantially planar, small contact plate arranged parallel to said one resistance plate surface portion; a separate spring ring having a resilient tongue for biasing the small contact plate against the resistance plate; said rotary driver including two slots at right angles with respect to each other which define four engaging fingers; said fingers being disposed in a rotary driver end facing the resistance plate; said resilient tongue being disposed in one of said two slots, and said small contact plate having projecting arms retained in the other of said two slots.

2. The trimming resistor as claimed in claim 1 in which said contact plate has two spaced contacts and said resilient tongue has a pistal end portion for engaging said contact plate approximately midway between the two contacts thereof.

3. The trimming resistor as claimed in claim 1 in which said spring ring has a flat, circular body in which said resilient tongue is connected integrally with the body at a proximal end, and has a distal end which is spaced from the plane of the body.

4. The trimming resistor as claimed in claim 1 in which the body of the spring ring surrounds the engaging fingers, and the spring ring body is supported on a projection of the housing protruding into a through bore in the housing, and calked ears axially retain said spring ring to said rotary driver.

5. The trimming resistor as claimed in claim 4 in which the rotary driver includes a circumferential, stepped portion which abuts against an end of the projection of the housing which is remote from the spring ring.

6. The trimming resistor as claimed in claim 1 in which the small contact plate comprises a flat body with two hemispherical projecting contacts, and further comprises arms projecting from the flat body originating adjacent the location of one contact; said arms being bent obliquely out of the plane of the body in the direction of the contact plate side remote from the hemispherical projecting contacts.

* * * * *